US008915724B2

(12) United States Patent
Nakashima et al.

(10) Patent No.: US 8,915,724 B2
(45) Date of Patent: Dec. 23, 2014

(54) SCROLL COMPRESSOR WITH CONTROL VALVE FOR CONTROLLING COOLING CAPACITY BASED ON SPEED AND CENTRIFUGAL FORCE

(71) Applicant: Kabushiki Kaisha Toyota Jidoshokki, Kariya (JP)

(72) Inventors: Akihiro Nakashima, Kariya (JP); Shinichi Sato, Kariya (JP); Akio Saiki, Kariya (JP)

(73) Assignee: Kabushiki Kaisha Toyota Jidoshokki (JP)

( * ) Notice: Subject to any disclaimer, the term of this patent is extended or adjusted under 35 U.S.C. 154(b) by 116 days.

(21) Appl. No.: 13/845,300

(22) Filed: Mar. 18, 2013

(65) Prior Publication Data

US 2013/0259728 A1 Oct. 3, 2013

(30) Foreign Application Priority Data

Mar. 29, 2012 (JP) ..... 2012-077202

(51) Int. Cl.

| | |
|---|---|
| ***F01C 1/02*** | (2006.01) |
| ***F01C 20/18*** | (2006.01) |
| ***F04C 18/00*** | (2006.01) |
| ***F01C 21/02*** | (2006.01) |
| ***F04C 28/26*** | (2006.01) |
| ***F04C 18/02*** | (2006.01) |
| *F04C 29/00* | (2006.01) |

(52) U.S. Cl.

CPC ..... *F04C 18/00* (2013.01); *F01C 21/02* (2013.01); *F04C 28/26* (2013.01); *F04C 18/0215* (2013.01); *F04C 29/0057* (2013.01); *F04C 2240/56* (2013.01)

USPC ..... 418/55.1; 418/17; 418/180; 417/310

(58) Field of Classification Search

USPC ..... 418/17, 40, 41, 55.1, 55.5, 180, 57, 418/151, 183; 417/307, 308, 310, 410.5

See application file for complete search history.

(56) References Cited

U.S. PATENT DOCUMENTS

| | | | | |
|---|---|---|---|---|
| 4,669,962 | A * | 6/1987 | Mizuno et al. | 418/55.5 |
| 5,013,225 | A * | 5/1991 | Richardson, Jr. | 418/1 |

(Continued)

FOREIGN PATENT DOCUMENTS

| | | | | |
|---|---|---|---|---|
| JP | 59-142491 | | 9/1984 | |
| JP | 02-294584 | | 12/1990 | |
| JP | 06147148 | A * | 5/1994 | F04C 18/02 |
| JP | 07-103161 | | 4/1995 | |

(Continued)

*Primary Examiner* — Thomas Denion
*Assistant Examiner* — Laert Dounis
(74) *Attorney, Agent, or Firm* — Baker & Hostetler LLP

(57) ABSTRACT

A scroll compressor includes an orbiting scroll member, a drive mechanism accommodation space, a rotary shaft, a drive bushing, an upstream space, a downstream space, a first communication passage and a second communication passage. The upstream space and the downstream space are formed in the drive mechanism accommodation space by a plain bearing, the drive bushing and an eccentric pin of the rotary shaft. The second communication passage passes through at least the drive bushing and allows the upstream space and the downstream space to communicate with each other. A control valve is disposed in the second communication passage. Centrifugal force of the control valve developed when the rotary shaft is rotated at a predetermined speed or higher causes the control valve to move in a direction in which the second communication passage is opened, thereby to allow the upstream space and the downstream space to communicate with each other.

6 Claims, 8 Drawing Sheets

(56) References Cited

U.S. PATENT DOCUMENTS

| | | | | |
|---|---|---|---|---|
| 6,086,342 | A * | 7/2000 | Utter | 418/55.5 |
| 6,716,009 | B2 * | 4/2004 | Sowa et al. | 418/55.1 |
| 7,118,358 | B2 * | 10/2006 | Tsubono et al. | 418/55.5 |

FOREIGN PATENT DOCUMENTS

| | | |
|---|---|---|
| JP | 09-112457 | 5/1997 |
| JP | 2001-304155 | 10/2001 |
| JP | 2011-185238 | 9/2011 |

* cited by examiner

SCROLL COMPRESSOR WITH CONTROL VALVE FOR CONTROLLING COOLING CAPACITY BASED ON SPEED AND CENTRIFUGAL FORCE

CROSS REFERENCE TO RELATED APPLICATIONS

This application claims priority to Japanese Application No. 2012-077202 filed Mar. 29, 2012.

BACKGROUND

The present invention relates to a scroll compressor and more particularly to a scroll compressor suitable for use in a vehicle.

There has been conventionally known a scroll compressor including a fixed scroll member and an orbiting scroll member. The orbiting scroll member is engaged with the fixed scroll member to form a plurality of sealed compression chambers. In the scroll compressor, refrigerant is compressed while the orbiting scroll member orbits relative to the fixed scroll member to reduce the volume of the compression chambers. In some cases, the scroll compressor forms a part of refrigerant circuit of an air conditioner for use in a vehicle. The reduction of volumetric efficiency of a scroll compressor occurring with an increase of the compressor speed is less than that of a piston compressor. The scroll compressor which is operated in conjunction with a vehicle engine may increase the cooling capacity excessively when the scroll compressor is operated at a high speed under a small load. Excessively increased cooling capacity of the scroll compressor increases excessively the power for driving the compressor and raises the discharge temperature of the refrigerant excessively, which reduces the reliability of the scroll compressor.

Japanese Unexamined Patent Application Publication No. 2011-185238 discloses a variable displacement type scroll compressor. The scroll compressor includes a fixed scroll member and an orbiting scroll member engaged with each other to form two sets of compression chambers, wherein the base plate of the fixed scroll member has therein a bypass port through which one set of the compression chambers and the suction chamber communicate with each other. The scroll compressor further includes a spool valve member that opens and closes the bypass port and a pressure control device having an electromagnetic valve. The opening and closing of the bypass port is controlled by the spool valve member and the pressure control device thereby to change the displacement of the scroll compressor. During the operation of the scroll compressor, part of the refrigerant only in one set of the compression chambers flows into the suction chamber via the bypass port.

Although the variable displacement type scroll compressor disclosed by the Japanese Unexamined Patent Application Publication No. 2011-185238 varies its displacement by allowing part of the refrigerant in one set of the compression chambers to flow into the suction chamber via the bypass port, it needs the spool valve member and the pressure control device thereby to complicate the structure and increase the number of parts of the scroll compressor. In addition, the Publication gives no consideration to the need of positively reducing the volumetric efficiency occurring when the scroll compressor is operated at a high speed for solving the problem of excessive increase in the cooling capacity caused when the scroll compressor is operated at a high speed.

The present invention, which has been made in light of the above-described problems, is directed to providing a scroll compressor that prevents an excessive increase in the cooling capacity that occurs in accordance with an increase of the speed of the scroll compressor and is simple in structure.

SUMMARY

In accordance with an aspect of the present invention, a scroll compressor includes a housing, a fixed scroll member, an orbiting scroll member, a drive mechanism accommodation space, a rotary shaft, a drive bushing, an upstream space, a downstream space, a first communication passage, a second communication passage and a control valve. The fixed scroll member is joined to the housing. The orbiting scroll member is disposed in the housing and engaged with the fixed scroll member so as to form plural sets of compression chambers. The orbiting scroll member has a boss. The drive mechanism accommodation space is formed by the housing and the orbiting scroll member. The rotary shaft is supported rotatably in the housing and has an eccentric pin disposed in the boss. The drive bushing is fitted on the eccentric pin and supported rotatably by the boss through a plain bearing. When the rotary shaft is rotated, the rotary shaft, the drive bushing and the plain bearing drive the orbiting scroll member so that the orbiting scroll member orbits relative to the fixed scroll member. The upstream space and the downstream space are formed in the drive mechanism accommodation space by the plain bearing, the drive bushing and the eccentric pin. The first communication passage passes through the orbiting scroll member and allows at least one of the compression chambers to communicate with the upstream space. The second communication passage passes through at least the drive bushing and allows the upstream space and the downstream space to communicate with each other. The control valve is disposed in the second communication passage. Centrifugal force of the control valve developed when the rotary shaft is rotated at a predetermined speed or higher causes the control valve to move in a direction in which the second communication passage is opened, thereby to allow the upstream space and the downstream space to communicate with each other.

Other aspects and advantages of the invention will become apparent from the following description, taken in conjunction with the accompanying drawings, illustrating by way of example the principles of the invention.

BRIEF DESCRIPTION OF THE DRAWINGS

The invention together with objects and advantages thereof, may best be understood by reference to the following description of the presently preferred embodiments together with the accompanying drawings in which.

DETAILED DESCRIPTION OF ILLUSTRATIVE EMBODIMENTS

The following will describe the scroll compressor according to the first embodiment of the present invention with reference to FIGS. 1 to 4. The scroll compressor according to the present embodiment forms a part of refrigerant circuit of an air conditioner for use in a vehicle.

Figure 1:
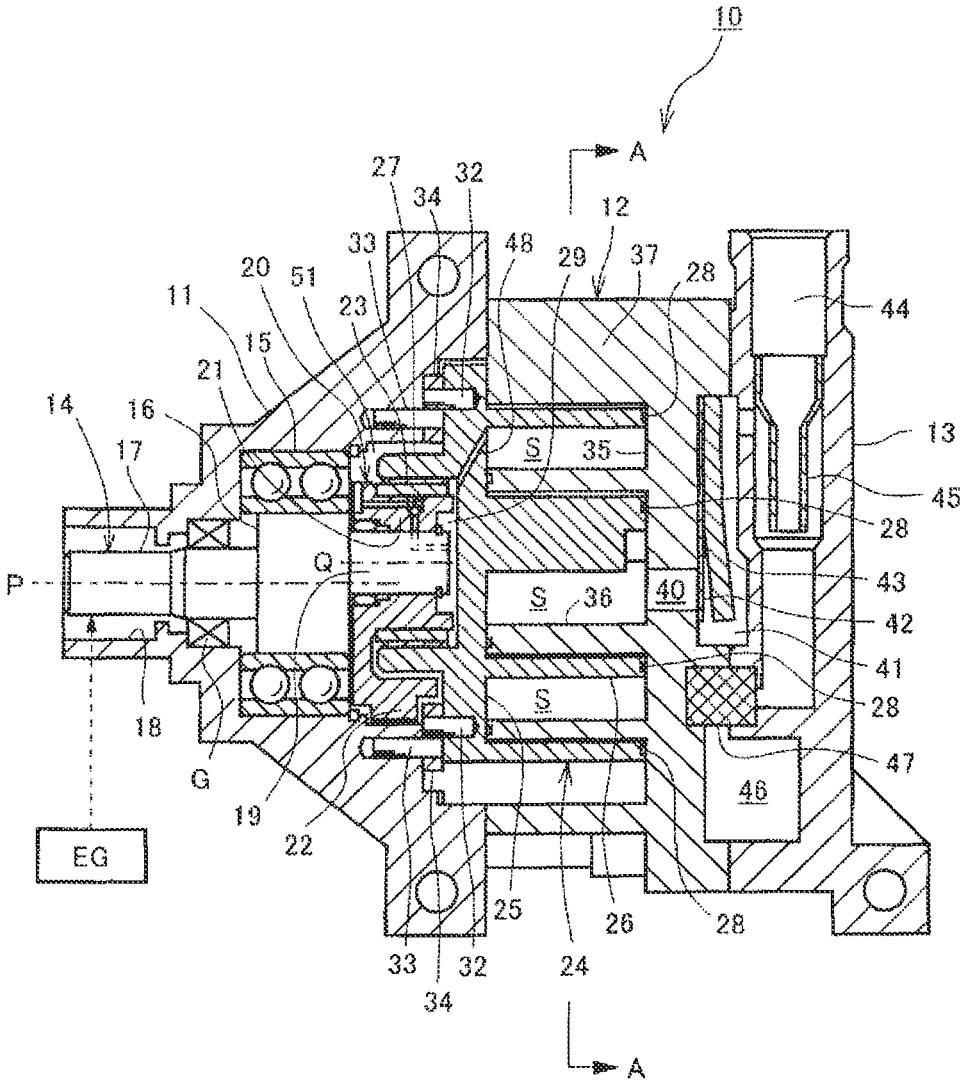
FIG. 1 is a longitudinal sectional view showing a scroll compressor according to a first embodiment of the present invention.

Referring to FIG. 1, the scroll compressor is designated generally by reference numeral 10. The scroll compressor 10 includes a first housing member 11, a fixed scroll member 12 joined to the first housing member 11, and a second housing member 13 joined to the fixed scroll member 12. The first housing member 11 has therein a bearing 15 and a rotary shaft 14 supported rotatably by the bearing 15. The rotary shaft 14 is rotatable around the axis P. The rotary shaft 14 has a large-diameter shaft portion 16 supported rotatably by the bearing 15 and a small-diameter input shaft portion 17 that extends from one end of the large-diameter shaft portion 16 toward the outside of the first housing member 11. The first housing member 11 has therethrough a hole 18 in which the small-diameter input shaft portion 17 is inserted. A pulley (not shown) which is driven to rotate via a belt (not shown) by an engine EG serving as an external drive source is mounted to the small-diameter input shaft portion 17 for rotating the rotary shaft 14. Thus, the speed of the rotary shaft 14 varies in accordance with the rotating speed of the engine EG.

Figure 2:
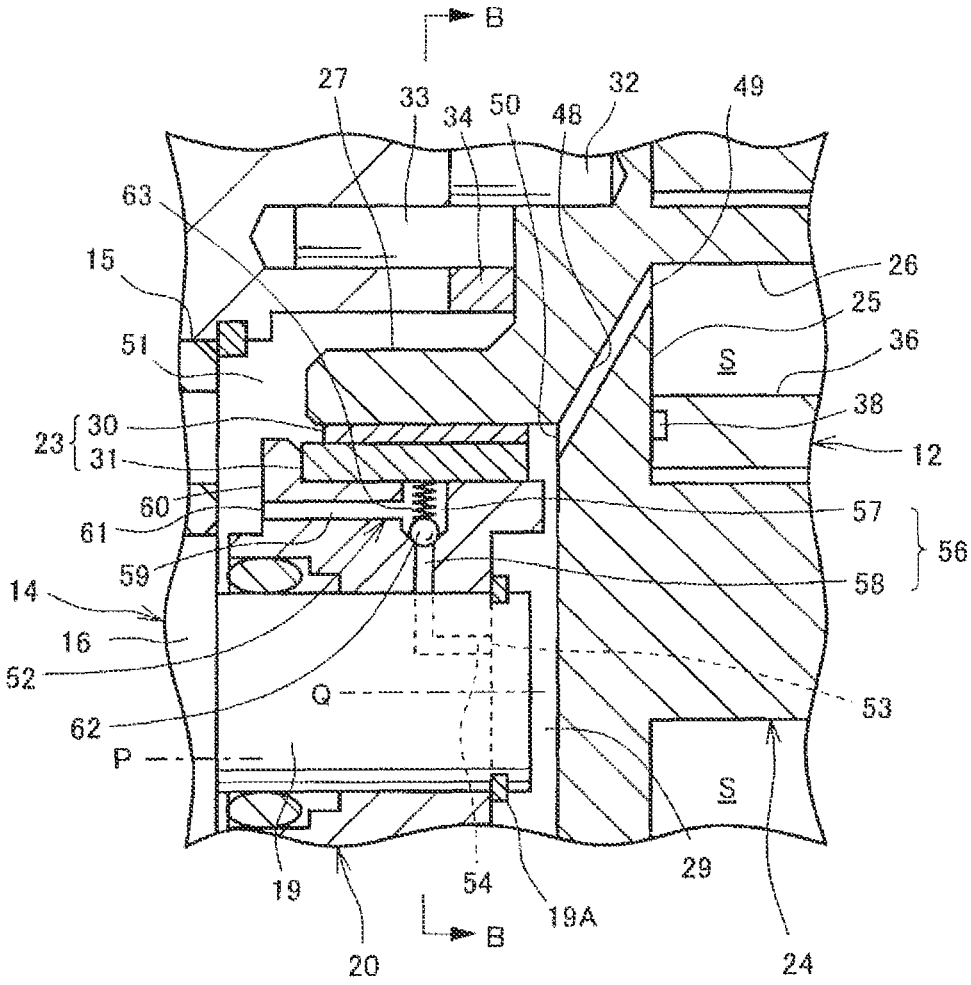
FIG. 2 is a fragmentary sectional view showing the scroll compressor of FIG. 1.

The rotary shaft 14 has an eccentric pin 19 that extends from the other end of the large-diameter shaft portion 16 toward the fixed scroll member 12. The axis Q of the eccentric pin 19 is located eccentrically with respect to the axis P of the rotary shaft 14. When the rotary shaft 14 is rotated, the eccentric pin 19 is revolved eccentrically with respect to the axis P of the rotary shaft 14. A drive bushing 20 of a substantially tubular shape is rotatably fitted on the eccentric pin 19. The drive bushing 20 has a cylindrical portion 21 that receives therein the eccentric pin 19 and a counterweight portion 22 that extends radially outward from the outer periphery of the cylindrical portion 21. The counterweight portion 22 corrects the imbalance of rotation caused by the eccentric movement of the eccentric pin 19 of the rotary shaft 14 and the cylindrical portion 21 of the drive bushing 20. As shown in FIG. 2, a circlip 19A is mounted on the eccentric pin 19 for preventing the drive bushing 20 from moving in the direction of the axis Q.

An orbiting scroll member 24 is rotatably connected to the drive bushing 20 via a bearing 23 at a position that is radially outward of the drive bushing 20. The orbiting scroll member 24 includes a circular base plate 25 that is located perpendicularly to the axis P, a spiral wall 26 that extends from one surface of the base plate 25 parallel to the axis P toward the fixed scroll member 12, and a boss 27 that extends from the other surface of the base plate 25 and also that supports the drive bushing 20 rotatably through the bearing 23. The base plate 25 has therethrough a first communication passage 48. A sealing member 28 is mounted in a groove formed in the distal end of the spiral wall 26.

The first housing member 11 and the orbiting scroll member 24 cooperate to form a drive mechanism accommodation space in which the large-diameter shaft portion 16 and the eccentric pin 19 of the rotary shaft 14, the drive bushing 20 and the bearing 23 are disposed. The large-diameter shaft portion 16, the eccentric pin 19, the drive bushing 20 and the bearing 23 serve as the drive mechanism for driving the orbiting scroll member 24. The drive mechanism divides the drive mechanism accommodation space into an upstream space 29 and a downstream space 51. The drive bushing 20 has therethrough a second communication passage 52 that allows the upstream space 29 and the downstream space 51 to communicate with each other.

The bearing 23, the drive bushing 20 and the eccentric pin 19 are disposed in the boss 27. The base plate 25, the boss 27, the bearing 23, the drive bushing 20 and the eccentric pin 19 cooperate to form the upstream space 29 of the drive mechanism accommodation space. The upstream space 29 is substantially closed.

The bearing 23 is a plain bearing interposed between the cylindrical portion 21 of the drive bushing 20 and the boss 27. As shown in FIG. 2, the bearing 23 includes a first plain bearing 30 and a second plain bearing 31. The first plain bearing 30 is press-fitted on the inner peripheral surface of the boss 27 and the second plain bearing 31 is press-fitted on the outer peripheral surface of the drive bushing 20. The first plain bearing 30 and the second plain bearing 31 are cylindrical bush bearings. The inner peripheral surface of the first plain bearing 30 and the outer peripheral surface of the second plain bearing 31 are in sliding contact with each other and serve as the sliding surfaces.

A plurality of pins 32 is press-fitted in the base plate 25 at positions adjacent to the outer periphery thereof, extending parallel to the axis P of the rotary shaft 14. A plurality of pins 33 is press-fitted in the first housing member 11 at positions adjacent to the pins 32, also extending parallel to the axis P of the rotary shaft 14. The pins 32 and 33 are inserted in the holes of a ring member 34. The pins 32, 33 and the ring member 34 cooperate to form the anti-rotation mechanism that prevents the orbiting scroll member 24 from rotating around the axis Q of the eccentric pin 19. When the rotary shaft 14 is rotated, the orbiting scroll member 24 orbits around the axis P without rotating around the axis Q of the eccentric pin 19, that is, the orbiting scroll member 24 orbits relative to the fixed scroll member 12 with non-rotation.

The fixed scroll member 12 includes a base plate 35 that is located perpendicularly to the axis P, a spiral wall 36 that extends from one surface of the base plate 35 parallel to the axis P toward the orbiting scroll member 24, and a shell 37 which is joined to the first housing member 11. As shown in FIG. 2, a sealing member 38 is mounted in the distal end of the spiral wall 36.

Figure 3:
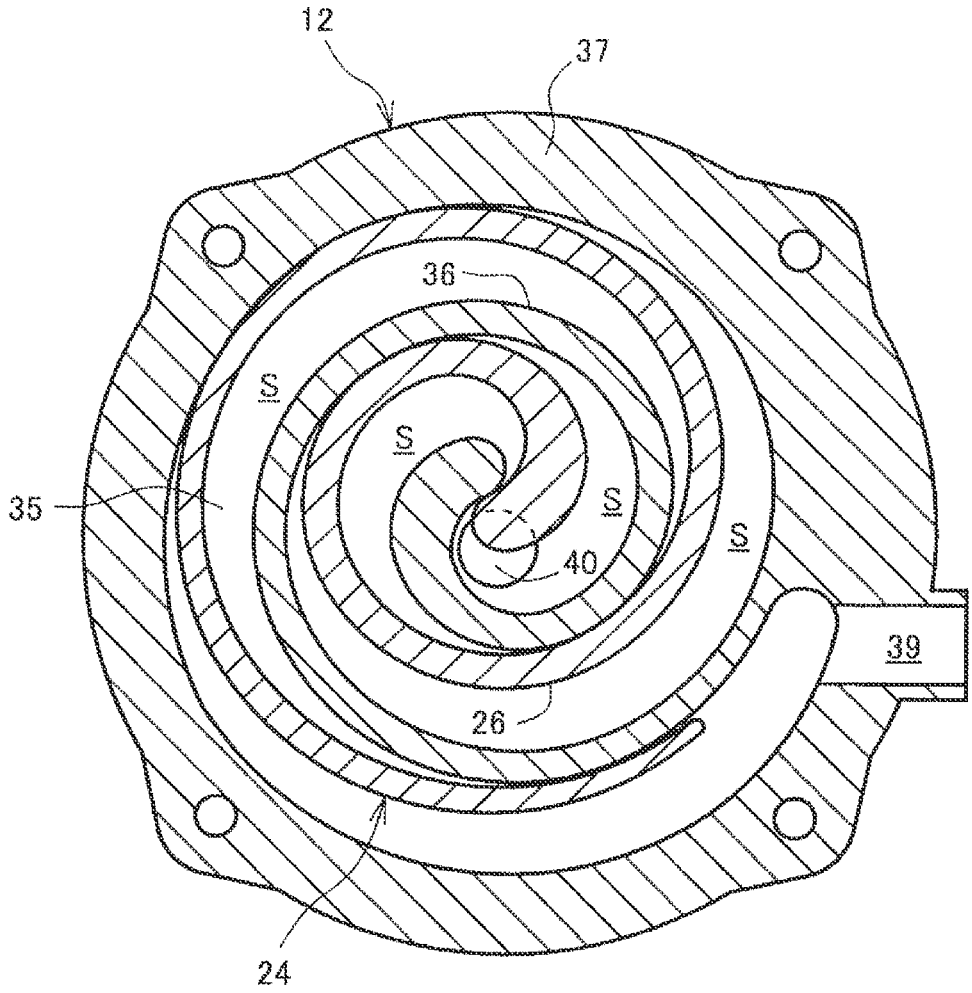
FIG. 3 is a cross sectional view taken along the line A-A in FIG. 1.
Figure 4:
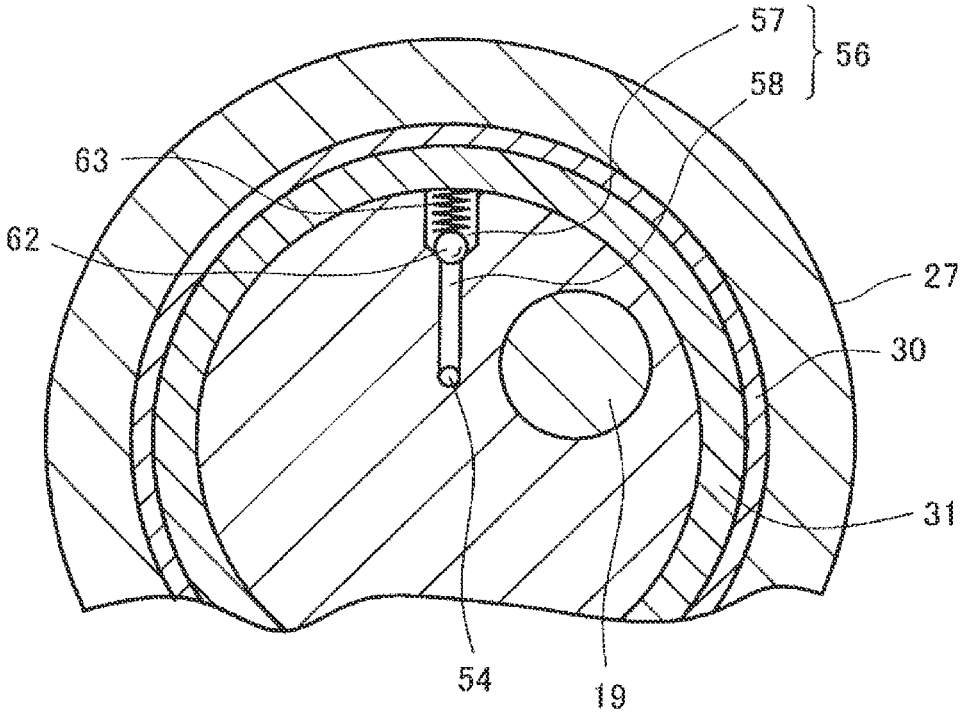
FIG. 4 is a cross sectional view taken along the line B-B in FIG. 2.

As shown in FIG. 3, the shell 37 of the fixed scroll member 12 has therethrough an inlet 39 that is connected to the external refrigerant circuit (not shown) of the scroll compressor 10 and allows refrigerant in the external refrigerant circuit to be drawn into the fixed scroll member 12. The base plate 35 of the fixed scroll member 12 has at the center thereof an outlet 40 through which compressed refrigerant is discharged out of compression chambers as will be described later.

The second housing member 13 is joined to the base plate 35 of the fixed scroll member 12. A discharge chamber 41 is formed between the base plate 35 and the second housing member 13 and communicates with the external refrigerant circuit through the outlet 40. A discharge valve 42 and a retainer 43 are fixed to the base plate 35 in the discharge chamber 41 by a bolt (not shown). The discharge valve 42 is made of a reed valve that opens and closes the outlet 40. The retainer 43 restricts the opening of the discharge valve 42. A discharge passage 44 is formed in the second housing member 13 and connected to the external refrigerant circuit.

A cylindrical oil separator 45 is disposed in the discharge passage 44. When refrigerant flows through the discharge passage 44, part of the lubricating oil contained in the refrigerant is separated from the refrigerant by the oil separator 45 and reserved in an oil chamber 46 that is formed below the discharge chamber 41. A filter 47 is located between the discharge passage 44 and the oil chamber 46 for removing foreign substance from the lubricating oil. The lubricating oil reserved in the oil chamber 46 is drawn into the compression chambers, which will be described later, via a passage (not shown) and the inlet 39.

In the scroll compressor 10, the spiral wall 26 of the orbiting scroll member 24 is engaged in contact with the spiral wall 36 of the fixed scroll member 12 so as to form two sets of compression chambers S between the spiral walls 26 and 36. It is noted that each set of compression chambers S includes a first compression chamber that is located adjacent to the outlet 40 and a second compression chamber that is located radially outward of the first compression chamber, as shown in FIG. 3. The first compression chambers S of the two sets have substantially the same volume, and the second compression chambers S of the two sets have substantially the same volume. The volume of the compression chambers S is reduced in accordance with the orbital motion of the orbiting scroll member 24 and the refrigerant in the compression chambers S is compressed in accordance with the reduction of the volume.

The first communication passage 48 and the second communication passage 52 are formed so as to allow refrigerant in one of the compression chambers S to flow into the downstream space 51 via the upstream space 29. The first communication passage 48 is formed in the base plate 25 of the orbiting scroll member 24 and interconnects the compression chamber S with the upstream space 29. The second communication passage 52 is formed in the drive bushing 20 and interconnects the upstream space 29 with the downstream space 51.

The following will describe the first communication passage 48. As shown in FIG. 2, the first communication passage 48 is formed through the base plate 25 of the orbiting scroll member 24 so that the compression chamber S and the upstream space 29 communicate with each other through the first communication passage 48. The first communication passage 48 allows the refrigerant in the compression chamber S to be supplied into the upstream space 29. The first communication passage 48 has an opening 49 that is opened to the compression chamber S and an opening 50 that is opened to the upstream space 29. The opening 49 is located adjacent to the base of the outermost part of the spiral wall 26. The opening 50 is located adjacent to the base of the boss 27 so as to face the end surface of the bearing 23. The downstream space 51 is sealed by a shaft seal G that is interposed between the first housing member 11 and the rotary shaft 14. The upstream space 29 and the downstream space 51 in the first housing member 11 are subject to suction pressure. The refrigerant in the compression chamber S under a pressure that is higher than the suction pressure flows into the upstream space 29 via the first communication passage 48.

The following will describe the second communication passage 52. As shown in FIG. 2, the second communication passage 52 is formed through the drive bushing 20. The second communication passage 52 has a first hole 54, a second hole 56 and a third hole 59. The first hole 54 is formed in the drive bushing 20, extending in the direction of the axis Q and communicates at an opening 53 with the upstream space 29. The second hole 56 is formed radially in the drive bushing 20 and extends from the first hole 54 to the outer peripheral surface of the drive bushing 20. The second hole 56 includes a radially outer hole 57 and a radially inner hole 58 whose diameter is smaller than that of the radially outer hole 57. The outer hole 57 has a tapered portion that is connected to the inner hole 58. The tapered portion of the outer hole 57 is formed by a tapered surface. The third hole 59 is formed in the drive bushing 20, extending in the direction of the axis Q from the outer hole 57 of the second hole 56 to an end surface 60 of the drive bushing 20 adjacent to the bearing 15. The third hole 59 communicates at an opening 61 with the downstream space 51.

A ball 62 as a valve member and a coil spring 63 as an urging member are disposed in the outer hole 57 of the second hole 56. The coil spring 63 is interposed between the ball 62 and the plain bearing 23 for urging the ball 62 from the outer hole 57 toward the inner hole 58 against the tapered surface so as to close the inner hole 58. The ball 62 and the coil spring 63 cooperate to form the control valve of the present invention. In the present embodiment, the second communication passage 52 is formed in the drive bushing 20 and the control valve is disposed also in the drive bushing 20. When the rotary shaft 14 is rotated at a predetermined speed or higher, centrifugal force causes the ball 62 to move radially outward against the urging force of the coil spring 63 thereby to open the inner hole 58 of the second hole 56. That is, the spring constant of the coil spring 63 that urges the ball 62 in the direction opposite to the direction of the centrifugal force is set at such a value that spring force of the coil spring 63 is below the centrifugal force when the rotary shaft 14 is rotated at the above predetermined speed or higher. The predetermined speed should desirably be set at a speed of the rotary shaft 14 at which excessive cooling occurs. Thus, the centrifugal force developed when the rotary shaft 14 is being rotated causes the control valve to move in the direction in which the second communication passage 52 is opened.

The following will describe the operation of the scroll compressor 10. When the power of the engine EG is transmitted to the rotary shaft 14 to rotate the rotary shaft 14, the rotary shaft 14, the drive bushing 20 fitted on the eccentric pin 19 and the bearing 23 drive the orbiting scroll member 24 so that the orbiting scroll member 24 orbits around the axis P. The pins 32, 33 and the ring member 34 prevent the orbiting scroll member 24 from rotating around its own axis. Thus, the orbiting scroll member 24 does not rotate around the eccentric pin 19, but orbits around the axis P with non-rotation.

While the orbiting scroll member 24 orbits around the axis P, the compression chambers S formed between the orbiting scroll member 24 and the fixed scroll member 12 are reduced in volume while moving radially inward. Therefore, the refrigerant drawn into the compression chambers S via the inlet 39 is compressed to a high pressure with reduction in volume of the compression chambers S, and discharged into the discharge chamber 41 via the outlet 40 by pushing open the discharge valve 42. The refrigerant discharged into the discharge chamber 41 is delivered to the discharge passage 44 in which the oil separator 45 separates lubricating oil from the refrigerant. The refrigerant whose lubricating oil is separated is delivered to the external refrigerant circuit. The separated lubricating oil is passed through the filter 47 and reserved in the oil chamber 46.

During the operation of the scroll compressor 10, the centrifugal force developed by the orbiting motion of the eccentric pin 19 acts on the ball 62 in the second communication passage 52. While the rotary shaft 14 of the scroll compressor 10 rotates at a speed that is lower than the aforementioned predetermined speed, the ball 62 closes the inner hole 58 because the urging force of the coil spring 63 remains greater than the centrifugal force of the ball 62. The refrigerant flowed from the compression chamber S into the upstream space 29 via the first communication passage 48 is shut off by the ball 62 then closing the inner hole 58 of the second hole 56, without flowing into the downstream space 51 via the second communication passage 52. While the rotary shaft 14 of the scroll compressor 10 rotates at a speed lower than the aforementioned predetermined speed, the air conditioner operates without decreasing its volumetric efficiency and increasing the cooling capacity excessively. While the ball 62 closes the inner hole 58 of the second hole 56, the lubricating oil contained in the refrigerant flowed into the upstream space 29 is reserved in the upstream space 29 or in the upstream passage of the second communication passage 52, which is located between the ball 62 and the upstream space 29.

While the rotary shaft 14 of the scroll compressor 10 rotates at the predetermined speed or higher, on the other hand, the ball 62 is moved radially outward under the influence of the centrifugal force then exceeding the urging force of the coil spring 63 thereby to open the inner hole 58, with the result that the upstream space 29 and the downstream space 51 communicate with each other. With the second communication passage 52 thus opened, part of the refrigerant in the compression chamber S flows into the downstream space 51 via the first communication passage 48, the upstream space 29 and the second communication passage 52. Thus, the volumetric efficiency of the scroll compressor 10 is reduced and, therefore, the cooling capacity of the air conditioner is prevented from being increased excessively. When the speed of the rotary shaft 14 of the scroll compressor 10 falls below the predetermined speed, the centrifugal force of the ball 62 becomes smaller than the urging force of the coil spring 63, thus moving the ball 62 radially inward thereby to close the inner hole 58. The lubricating oil contained in the refrigerant flowed into the downstream space 51 lubricates sliding members such as the bearing 15, the pins 32, 33 and the ring member 34 in the downstream space 51.

The scroll compressor 10 of the present embodiment has the following advantageous effects.

(1) While the rotary shaft 14 of the scroll compressor 10 rotates at the predetermined speed or higher, the centrifugal force of the ball 62 then developed is greater than the urging force of the coil spring 63 thereby to cause the ball 62 to open the second communication passage 52. With the second communication passage 52 thus opened, part of the refrigerant in the compression chamber S flows into the downstream space 51 in the first housing member 11 via the first communication passage 48, the upstream space 29 and the second communication passage 52. Such flowing of the refrigerant in the compression chamber S into the downstream space 51 causes the volumetric efficiency of the scroll compressor 10 to be reduced and, therefore, the cooling capacity of the air conditioner is reduced. In the present embodiment, the second communication passage 52 is opened and closed depending on the rotating speed of the rotary shaft 14 of the scroll compressor 10. While the rotary shaft 14 of the scroll compressor 10 rotates at the predetermined speed or higher, the cooling capacity of the air conditioner is prevented from being increased excessively.

(2) When the speed of the rotary shaft 14 of the scroll compressor 10 is increased, the flow rate of the refrigerant being discharged is increased. Although the cooling capacity (compression ratio) is determined depending on the structure of the compression mechanism of the scroll compressor 10, if the flow rate of the refrigerant being discharged is increased excessively, the actual cooling capacity exceeds the cooling capacity that is determined depending on the structure of the compression mechanism. If the cooling capacity is increased excessively, the discharge temperature of the refrigerant is increased abnormally, so that the reliability of the scroll compressor 10 is reduced. Abnormal increase of the discharge temperature of the refrigerant causes an increased power requirement and hence a decreased efficiency of the scroll compressor 10. In the present embodiment wherein the cooling capacity is reduced by opening the second communication passage 52 depending on the rotating speed of the rotary shaft 14 of the scroll compressor 10, the cooling capacity of the air conditioner is prevented from being increased excessively.

(3) The ball 62 as a valve member and the coil spring 63 as an urging member provide the control valve for the scroll compressor 10 of the present embodiment. Simple structure of the control valve is advantageous in reducing the cost of the scroll compressor 10.

(4) In the present embodiment wherein the bearing 23 is provided by a plain bearing, appropriate fluid-tightness may be accomplished between the upstream space 29 and the downstream space 51 when the second communication passage 52 is closed by the ball 62 of the control valve. When the ball 62 closes the second communication passage 52, the volumetric efficiency of the scroll compressor 10 is reduced. Therefore, neither opening and closing device nor throttle is needed in the first communication passage 48.

(5) In the scroll compressor 10 of the present embodiment, while the rotary shaft 14 of the scroll compressor 10 rotates at the predetermined speed or higher, the centrifugal force of the ball 62 then developed is greater than the urging force of the coil spring 63, so that the second communication passage 52 is opened. When the second communication passage 52 is opened, part of the refrigerant in the compression chamber S flows into the downstream space 51 via the second communication passage 52 thereby to reduce the cooling capacity of the air conditioner. While the rotary shaft 14 of the scroll compressor 10 rotates at a speed lower than the predetermined speed, the centrifugal force of the ball 62 is smaller than the urging force of the coil spring 63, so that the second communication passage 52 is closed. When the second communication passage 52 is closed, the lubricating oil contained in the refrigerant flowed into the upstream space 29 is reserved in the upstream space 29 or in the upstream passage of the second communication passage 52, which is located between the ball 62 and the upstream space 29.

(6) In the scroll compressor 10 of the present embodiment, the ball 62 of the control valve that is moved by centrifugal force is disposed in the second communication passage 52 of the drive bushing 20. As compared to the case where a control valve that opens and closes the second communication passage by centrifugal force is disposed at a position adjacent to the axis P of the rotary shaft 14, the present control valve which is located farther from the axis P than the comparative control valve develops a larger centrifugal force than the comparative control valve. Therefore, the centrifugal force acts on the ball 62 more effectively.

Figure 5:
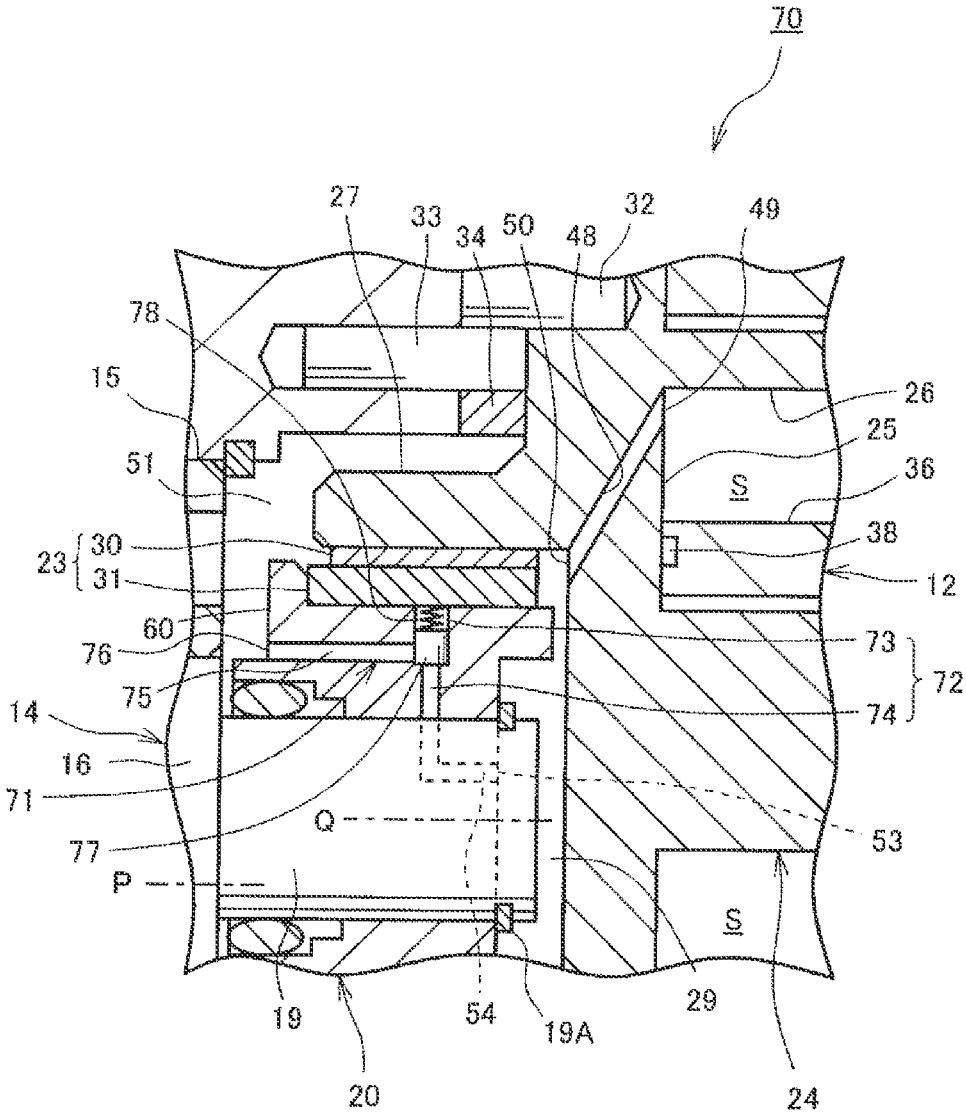
FIG. 5 is a fragmentary sectional view showing a scroll compressor according to a second embodiment of the present invention.

The following will describe the scroll compressor according to the second embodiment of the present invention with reference to FIG. 5. The scroll compressor of the second embodiment differs from the counterpart of the first embodiment in the structure of the second communication passage and the control valve. In the following description of the second embodiment, the same reference numerals as used in the description of the first embodiment will be used and the description of the same parts and elements will be omitted.

FIG. 5 is a fragmentary sectional view showing the scroll compressor 70 according to the second embodiment. Referring to the drawing, the second communication passage 71 that corresponds to the second communication passage 52 of the first embodiment has a first hole 54, a second hole 72 and a third hole 75 that are all formed in the drive bushing 20. The second hole 72 has a radially outer hole 73 and a radially inner hole 74 whose diameter is smaller than that of the radially outer hole 73. The third hole 75 extends from the outer hole 73 of the second hole 72 in the direction of the axis Q to the end surface 60 of the drive bushing 20. The third hole 75 communicates at an opening 76 with the downstream space 51.

A spool 77 as a valve member and a coil spring 78 as an urging member are disposed in the outer hole 73 of the second hole 72. The spool 77 is cylindrical and movable in the outer hole 73 in the radial direction of the drive bushing 20. The coil spring 78 is interposed between the spool 77 and the plain bearing 23 for urging the spool 77 so as to close the inner hole 74 of the second hole 72. The spool 77 and the coil spring 78 cooperate to form the control valve. In the present embodiment, the second communication passage 71 is formed in the drive bushing 20 and the control valve is disposed in the drive bushing 20. When the rotary shaft 14 is rotated at a predetermined speed or higher, the centrifugal force then developed causes the spool 77 to move radially outward against the urging force of the coil spring 78 thereby to open the inner hole 74 of the second hole 72. That is, the control valve including the spool 77 and the coil spring 78 in the second communication passage 71 is operated by the centrifugal force to allow the upstream space 29 and the downstream space 51 to communicate with each other. The spring constant of the coil spring 78 that urges the spool 77 against the centrifugal force is set at such a value that the spring force of the coil spring 78 is smaller than the centrifugal force developed when the rotary shaft 14 is rotated at a predetermined speed or higher. The predetermined speed should desirably be set at a speed of the rotary shaft 14 at which excessive cooling capacity occurs.

In the present embodiment, while the rotary shaft 14 rotates at the predetermined speed or higher, the spool 77 of the control valve is moved for a distance that is variable with the speed. The opening of the second communication passage 71 is controlled in accordance with the moving distance of the spool 77, thus changing the flow rate of the refrigerant passing through the second communication passage 71. That is, the spool 77 serves to control the opening of the second communication passage 71.

The scroll compressor 70 of the second embodiment has substantially the same advantageous effects as those (1) to (6) of the first embodiment. In addition, in the scroll compressor 70 of the second embodiment wherein the moving distance of the spool 77 is changed in accordance with the speed of the rotary shaft 14 rotating at the predetermined speed or higher, the flow rate of the refrigerant flowing through the second communication passage 71 is controlled thereby to reduce the volumetric efficiency of the scroll compressor 70. That is, while the rotary shaft 14 of the scroll compressor 70 rotates at the predetermined speed or higher, the volumetric efficiency of the scroll compressor 70 is reduced further with an increase of the speed.

Figure 6:
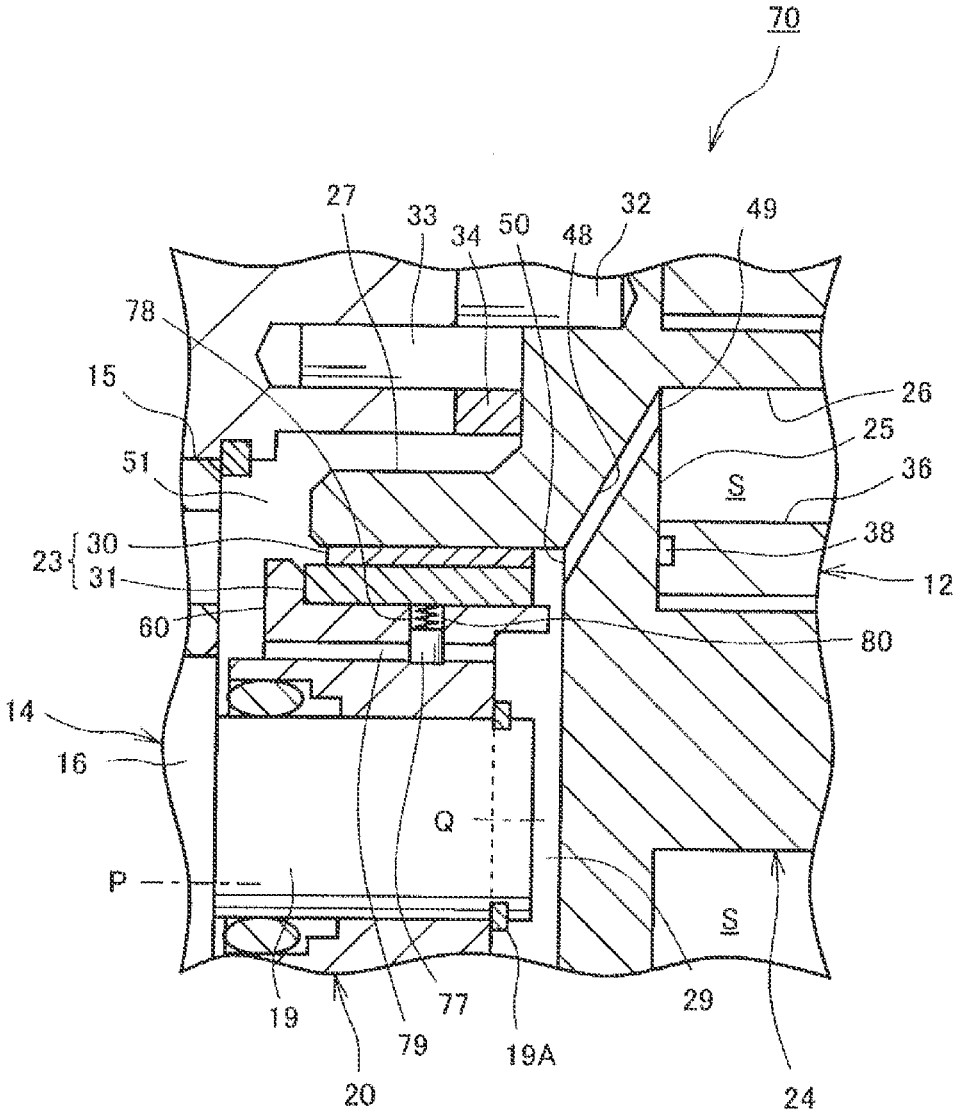
FIG. 6 is a fragmentary sectional view showing a scroll compressor according to a modification of the second embodiment.

In a modification of the second embodiment, the second communication passage 79 corresponding to the second communication passage 71 of the second embodiment shown in FIG. 5 is formed through the drive bushing 20 in the direction of the axis Q and a hole 80 is formed in the radial direction of the drive bushing 20 and connected to the second communication passage 79, as shown in FIG. 6. The spool 77 and the coil spring 78 are disposed in the hole 80. The present modification has substantially the same effects as the second embodiment. In addition, the scroll compressor 70 of the present modification is advantageous in that the number of holes to be drilled in the drive bushing 20 is reduced and the manufacturing cost is reduced, accordingly.

Figure 7:
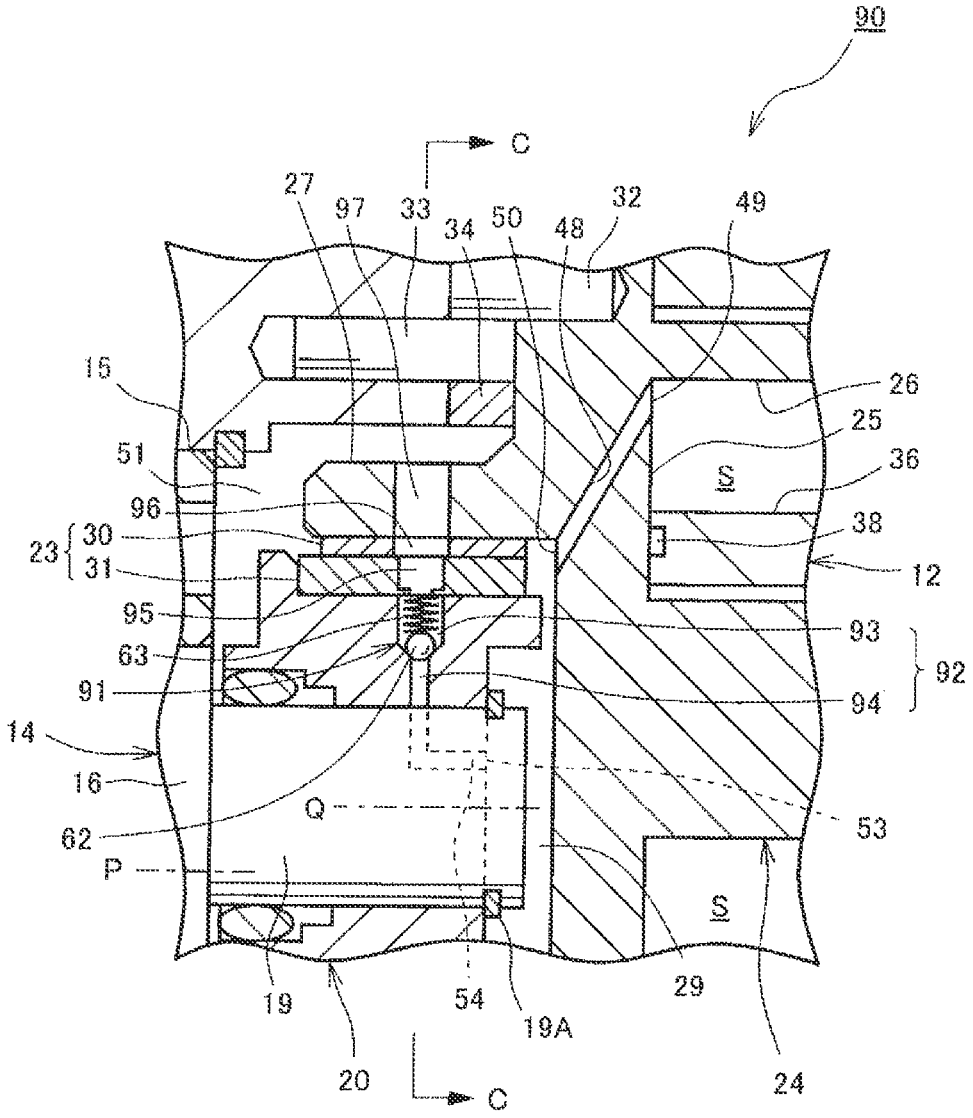
FIG. 7 is a fragmentary sectional view showing a scroll compressor according to a third embodiment of the present invention.
Figure 8:
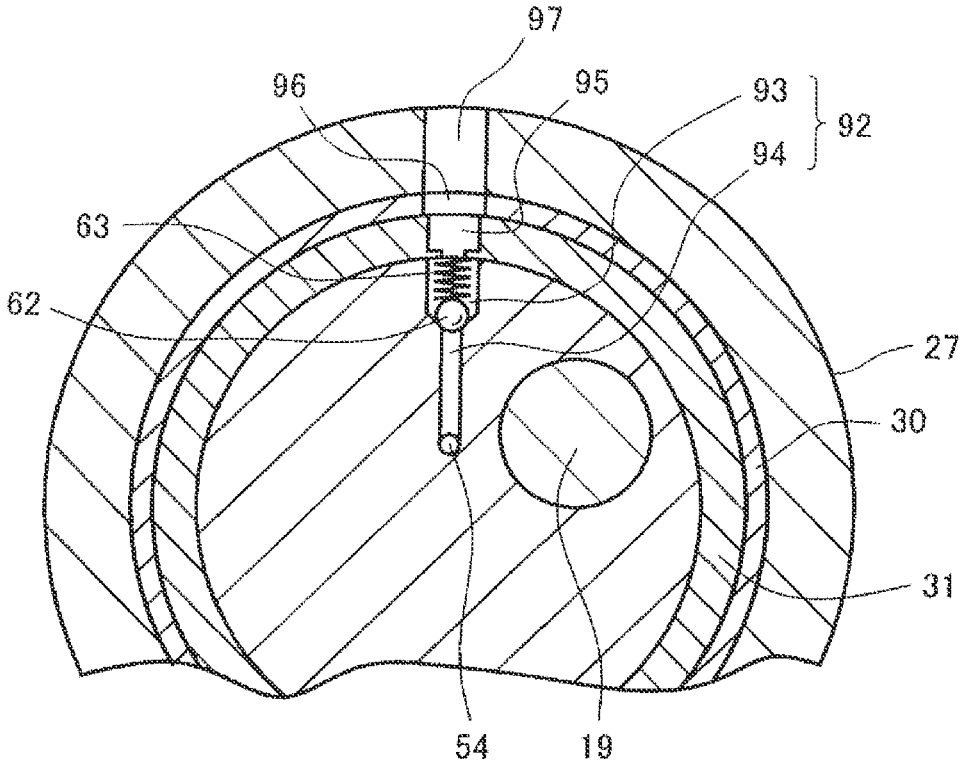
FIG. 8 is a fragmentary cross sectional view taken along the line C-C in FIG. 7.

The following will describe the scroll compressor according to the third embodiment of the present invention with reference to FIGS. 7 and 8. The scroll compressor of the second embodiment differs from the counterpart of the first embodiment in the structure of the second communication passage and the control valve. In the following description of the third embodiment, the same reference numerals as used in the description of the first embodiment will be used and the description of the same parts and elements will be omitted.

FIG. 7 is a fragmentary sectional view showing the scroll compressor 90 according to the third embodiment. Referring to the drawing, the second communication passage 91 corresponding to the second communication passage 52 of the first embodiment has a first hole 54 and a second hole 92 that is formed in the radial direction of the drive bushing 20, holes 95, 96 and 97. The second hole 92 has a radially outer hole 93 and a radially inner hole 94 whose diameter is smaller than that of the radially outer hole 93 and which is connected to the first hole 54. The hole 95 extends through the second plain bearing 31 radially so as to communicate with the second hole 92 of the second communication passage 91. The hole 96 extends through the first plain bearing 30 radially, and the hole 97 extends through the boss 27 radially so as to communicate with the hole 96. As shown in FIGS. 7 and 8, the holes 95 and 96 are formed so as to be communicable with each other.

The hole 97 in the boss 27 serves as the first radial passage, and the hole 95 in the second plain bearing 31 and the hole 96 in the first plain bearing 30 serve as the second radial passage. That is, the second communication passage 91 includes the first radial passage and the second radial passage and communicates with the upstream space 29 and the downstream space 51.

The ball 62 and the coil spring 63 are disposed in the outer hole 93 of the second hole 92 and serve as the valve member and the urging member, respectively. The ball 62 in the outer hole 93 is movable in the radial direction of the drive bushing 20. The coil spring 63 is interposed between the ball 62 and the plain bearing 23 for urging the ball 62 in the direction to close the inner hole 94. The ball 62 and the coil spring 63 cooperate to form the control valve. In the present embodiment, the second communication passage 91 is formed in the drive bushing 20 and the control valve is disposed in the drive bushing 20.

While the rotary shaft 14 rotates at a predetermined speed or higher, the centrifugal force then developed causes the ball 62 to move radially outward against the urging force of the coil spring 63 thereby to open the inner hole 94 of the second hole 92. That is, the spring constant of the coil spring 63 that urges the ball 62 in the direction opposite to the direction of the centrifugal force is set at such a value that the spring force of the coil spring 63 is below the centrifugal force when the rotary shaft 14 is rotated at the predetermined speed or higher. The predetermined speed should desirably be set at a speed of the rotary shaft 14 at which excessive cooling capacity occurs.

In the present embodiment, when the hole 95 of the second plain bearing 31 and the hole 96 of the first plain bearing 30 are located to face each other with the inner hole 94 of the second hole 92 opened, the refrigerant in the upstream space 29 flows into the downstream space 51 via the second communication passage 91. When the hole 95 of the second plain bearing 31 and the hole 96 of the first plain bearing 30 are not located to face each other with the inner hole 94 opened, the second communication passage 91 is closed and hence the flow of refrigerant in the upstream space 29 into the downstream space 51 is blocked. In the present embodiment wherein the hole 95 of the second plain bearing 31 and the hole 96 of the first plain bearing 30 communicate with each other in accordance with the rotation of the rotary shaft 14, the refrigerant in the upstream space 29 flows into the downstream space 51 intermittently.

According to the present embodiment, even in the structure where the second communication passage is not opened at the position such as the end surface 60 of the drive bushing 20, the refrigerant in the upstream space 29 is allowed to flow into the downstream space 51. A plurality of holes 97 may be formed in the boss 27 at angularly space positions and a plurality of holes 96 may be formed in the first plain bearing 30 at angularly space positions, which allows a larger amount of refrigerant in the upstream space 29 to flow into the downstream space 51.

The present invention has been described in the context of the above embodiments, but it is not limited to those embodiments. It is obvious to those skilled in the art that the invention may be practiced in various manners as exemplified below.

Although in each of the above-describe embodiments the second communication passage is formed in the drive bushing 20 or in the drive bushing 20, the bearing 23 and the boss 27 and the control valve is disposed in the drive bushing 20, it may be so arranged that the second communication passage is formed in the drive bushing 20 and also in the eccentric pin 19 and the control valve is disposed in the eccentric pin 19. This modification offers substantially the same effects as the above-describe embodiments.

The valve member of the control valve is not limited to a ball or a cylindrical spool as in the above-describe embodiments, but any member may be used for the control valve as long as it is movable by the centrifugal force developed when the rotary shaft is rotated at a predetermined speed or higher thereby to open the second communication passage.

The coil spring used as the urging member in the above-described embodiments may be replaced with any suitable spring such as a leaf spring or a disc spring, and also with a resilient member made of a rubber.

Although in each of the above-described embodiments the scroll compressor forms a part of refrigerant circuit of an air conditioner for use in a vehicle, the scroll compressor according to the present invention is not limited to such application.

Although in each of the above-described embodiments the drive bushing 20 is rotatably fitted on the eccentric pin 19, it may be press-fitted on the eccentric pin 19.

What is claimed:

1. A scroll compressor comprising:

a housing;

a fixed scroll member joined to the housing;

an orbiting scroll member disposed in the housing and engaged with the fixed scroll member so as to form plural sets of compression chambers, the orbiting scroll member having a boss;

a drive mechanism accommodation space formed by the housing and the orbiting scroll member;

a rotary shaft supported rotatably in the housing and having an eccentric pin disposed in the boss;

a drive bushing fitted on the eccentric pin and supported rotatably by the boss through a plain bearing, wherein when the rotary shaft is rotated, the rotary shaft, the drive bushing and the plain bearing drive the orbiting scroll member so that the orbiting scroll member orbits relative to the fixed scroll member;

an upstream space and a downstream space formed in the drive mechanism accommodation space by the plain bearing, the drive bushing and the eccentric pin;

a first communication passage passing through the orbiting scroll member and allowing at least one of the compression chambers to communicate with the upstream space;

a second communication passage passing through at least the drive bushing and allowing the upstream space and the downstream space to communicate with each other;

a control valve disposed in the second communication passage, wherein centrifugal force of the control valve developed when the rotary shaft is rotated at a predetermined speed or higher causes the control valve to move in a direction in which the second communication passage is opened, thereby to allow the upstream space and the downstream space to communicate with each other.

2. The scroll compressor according to claim 1, wherein the control valve has a valve member and an urging member, the valve member being movable in a radial direction of the drive bushing, the urging member urging the valve member in a direction opposite to a direction of centrifugal force acting on the valve member when the rotary shaft is rotated.

3. The scroll compressor according to claim 2, wherein the valve member is a ball.

4. The scroll compressor according to claim 2, wherein the valve member is a spool.

5. The scroll compressor according to claim 1, wherein the control valve is disposed in the second communication passage formed in the drive bushing.

6. The scroll compressor according to claim 5, wherein the second communication passage passes through the boss, the plain bearing and the drive bushing and includes a first radial passage that passes through the boss and a second radial passage that passes through the plain bearing.

* * * * *